US010358153B2

(12) United States Patent
Singleton et al.

(10) Patent No.: US 10,358,153 B2
(45) Date of Patent: Jul. 23, 2019

(54) TOP OF RAIL FOAM BAR

(71) Applicant: L.B. Foster Rail Technologies, Inc., Pittsburgh, PA (US)

(72) Inventors: Steven D. Singleton, Sarver, PA (US); W. Thomas Urmson, Valencia, PA (US); Matthew Redfield, Pittsburgh, PA (US); Christopher A. Lucke, Natrona Heights, PA (US)

(73) Assignee: L.B. Foster Rail Technologies, Inc., Pittsburgh, PA (US)

( * ) Notice: Subject to any disclaimer, the term of this patent is extended or adjusted under 35 U.S.C. 154(b) by 0 days.

(21) Appl. No.: 15/452,484

(22) Filed: Mar. 7, 2017

(65) Prior Publication Data

US 2017/0174235 A1 Jun. 22, 2017

Related U.S. Application Data

(63) Continuation of application No. 14/075,829, filed on Nov. 8, 2013, which is a continuation-in-part of application No. 12/788,971, filed on May 27, 2010, now Pat. No. 8,955,645.

(60) Provisional application No. 61/182,217, filed on May 29, 2009.

(51) Int. Cl.
*B61K 3/00* (2006.01)
*E01B 7/26* (2006.01)

(52) U.S. Cl.
CPC . *B61K 3/00* (2013.01); *E01B 7/26* (2013.01)

(58) Field of Classification Search
CPC ..... B61K 3/00; E01B 7/26
See application file for complete search history.

(56) References Cited

U.S. PATENT DOCUMENTS 804,787 A * 11/1905 Young ..... E01B 7/24 126/271.2 B
1,097,704 A * 5/1914 Cassidy et al. ..... B61K 3/00 184/3.1
1,205,711 A * 11/1916 Clark ..... B61K 3/00 184/3.1

(Continued)

FOREIGN PATENT DOCUMENTS

AU 2013305452 9/2016
CA 2485289 11/2003

(Continued)

OTHER PUBLICATIONS

L.B. Foster Rail Technologies, Inc., Australian Examination Report from Australian Patent Application No. 2013305452, dated Dec. 4, 2015, 2 pages.

(Continued)

*Primary Examiner* — Michael A Riegelman
(74) *Attorney, Agent, or Firm* — Kenneth H. Sonnenfeld; Kristine Waddell; King & Spalding LLP

(57) ABSTRACT

A rail applicator assembly includes a rail having a head portion, a base portion, and a web portion extending between the head portion and the base portion. The head portion defines an outer surface. An applicator for applying a friction modifying material to the surface of the rail includes a foam body and an applicator support. The foam body is secured to the applicator support and defines a flow passageway that extends through the foam body for friction modifying material to flow through.

20 Claims, 11 Drawing Sheets

(56) References Cited

U.S. PATENT DOCUMENTS 1,546,778 A * 7/1925 De Niff ..... E01B 7/20 184/3.1
1,630,584 A * 5/1927 Schneider ..... E01B 11/02 184/3.1
1,669,603 A * 5/1928 Derrick ..... B61K 3/00 184/3.1
1,728,412 A * 9/1929 Humphries ..... B61K 3/00 184/3.1
1,745,213 A * 1/1930 Gray ..... B61K 3/00 184/3.1
1,803,923 A * 5/1931 Tanner ..... B61K 3/00 184/3.1
1,839,427 A * 1/1932 Warr ..... B61K 3/00 184/3.1
1,878,259 A * 9/1932 Bodkin ..... B61K 3/00 184/3.1
1,939,846 A * 12/1933 Fenton ..... A41G 1/009 156/279
1,940,527 A * 12/1933 Bolt ..... B61K 3/00 184/3.1
1,968,809 A * 8/1934 Curtis ..... A63C 19/04 427/202
1,978,906 A * 10/1934 Madison ..... B61K 3/00 184/3.1
1,979,447 A * 11/1934 Butcher ..... B61K 3/00 184/3.1
2,018,402 A * 10/1935 Humphries ..... B61K 3/00 184/3.1
2,152,696 A * 4/1939 Huck ..... B61K 3/00 184/27.1
2,185,810 A * 1/1940 Heidenthal ..... B61K 3/00 184/3.1
2,231,394 A * 2/1941 Reece ..... B61K 3/00 184/3.1
2,262,852 A * 11/1941 Martin ..... B61K 3/00 184/3.1
2,272,774 A * 2/1942 McGarry ..... B61K 3/00 184/3.1
2,489,182 A * 11/1949 Huck ..... B61K 3/00 184/3.1
2,555,615 A * 6/1951 Stern ..... B61K 3/00 184/3.1
2,821,263 A * 1/1958 Kerler ..... B61K 3/00 184/3.1
2,887,179 A * 5/1959 Steele ..... B61K 3/00 184/3.1
2,980,942 A * 4/1961 Dabney, Jr. ..... B61K 3/00 15/210.1
3,147,822 A * 9/1964 Watts ..... B61K 3/00 184/3.1
3,491,338 A * 1/1970 Malloy ..... H04L 7/042 340/309.4
3,617,139 A * 11/1971 Ross ..... A47L 13/22 401/156
4,088,078 A * 5/1978 Noble ..... B61K 7/08 104/26.2
4,220,322 A * 9/1980 Hobday ..... B25B 5/067 269/214
4,436,294 A * 3/1984 Irelan ..... B25B 5/10 269/227
4,753,424 A 6/1988 Sato et al.
4,915,195 A * 4/1990 Dial ..... B61K 3/00 184/3.2
5,156,508 A * 10/1992 Grisley ..... B25B 5/08 269/236
5,217,213 A * 6/1993 Lii ..... B25B 5/06 269/6
5,348,120 A * 9/1994 Junk ..... B61K 3/00 104/279
5,394,958 A * 3/1995 Junk ..... B61K 3/00 104/279
5,518,085 A * 5/1996 Houser, Jr. ..... B61K 3/00 184/3.1
5,641,037 A * 6/1997 Wise ..... B61K 3/00 104/279
5,722,509 A * 3/1998 Clinger ..... B61K 3/00 138/106
5,957,241 A * 9/1999 Anderson ..... E04H 6/428 184/106
5,972,470 A * 10/1999 Engst ..... B01J 20/28004 184/106
5,996,736 A * 12/1999 Stankiewicz ..... B60R 9/0485 182/127
6,009,978 A * 1/2000 Chisholm ..... B61K 3/02 105/199.2
6,010,268 A * 1/2000 Sereg ..... A47L 1/15 15/244.1
6,250,621 B1 * 6/2001 Ping ..... B25B 5/10 269/181
6,401,867 B1 * 6/2002 Michioka ..... B23Q 1/58 184/100
6,475,594 B2 * 11/2002 Johnston ..... A47L 23/266 184/106
6,742,624 B2 * 6/2004 DiCarlo ..... B61K 3/00 104/279
6,759,372 B2 * 7/2004 Cotter ..... B61K 3/00 508/143
6,899,940 B2 * 5/2005 Leriget ..... E04H 6/428 184/106
6,971,479 B1 * 12/2005 Urmson, Jr. ..... B61K 3/00 152/2
7,121,383 B2 * 10/2006 Kumar ..... B61K 3/00 184/3.1
7,216,558 B2 * 5/2007 Kumar ..... B61L 1/02 73/866.5
7,258,201 B2 8/2007 Urmson et al.
7,273,131 B2 9/2007 Urmson et al.
7,530,502 B2 * 5/2009 Sherriff ..... B61K 9/10 238/14.13
7,557,147 B2 * 7/2009 Martinez ..... C08J 9/04 521/142
7,578,388 B2 * 8/2009 O'Connell ..... B05C 17/002 206/223
8,025,279 B2 * 9/2011 Seber ..... B25B 5/101 269/143
8,074,772 B2 12/2011 Urmson, Jr. et al.
8,235,307 B2 * 8/2012 Schatz ..... F16B 2/12 238/14.05
8,584,804 B2 11/2013 Holland
8,783,416 B2 * 7/2014 Singleton ..... B61K 3/00 184/3.1
8,955,645 B2 2/2015 Singleton et al.
9,440,665 B2 9/2016 Singleton et al.
2002/0056592 A1 * 5/2002 Arens ..... B61K 3/00 184/3.1
2004/0050623 A1 * 3/2004 Urmson, Jr. ..... B61K 3/00 184/3.1
2004/0228672 A1 11/2004 Colburn et al.
2005/0269161 A1 12/2005 Urmson, Jr. et al.
2008/0047780 A1 * 2/2008 Urmson, Jr. ..... B61K 3/00 184/3.1
2008/0083584 A1 * 4/2008 Urmson, Jr. ..... B61K 3/00 184/3.1
2008/0223661 A1 * 9/2008 Singleton ..... B61K 3/00 184/3.1
2009/0000869 A1 * 1/2009 Holland ..... B61K 3/00 184/3.1
2009/0000870 A1 * 1/2009 Holland ..... B61K 3/00 184/3.1
2009/0050409 A1 * 2/2009 Wakamatsu ..... B61K 3/00 184/3.1
2010/0101893 A1 * 4/2010 Sutton ..... B61K 3/00 184/3.1

(56) References Cited

U.S. PATENT DOCUMENTS

| | | | | |
|---|---|---|---|---|
| 2010/0300810 | A1* | 12/2010 | Singleton | E01B 7/26 184/3.1 |
| 2014/0054113 | A1* | 2/2014 | Powell | B61K 3/00 184/3.1 |
| 2014/0060972 | A1* | 3/2014 | Appleby | B61K 3/00 184/3.1 |

FOREIGN PATENT DOCUMENTS

| | | |
|---|---|---|
| CA | 2763205 | 12/2010 |
| CN | 2037746 | 5/1989 |
| CN | 2040059 | 6/1989 |
| EP | 1 418 222 | 5/2004 |
| EP | 1807489 | 7/2007 |
| GB | 415174 | 8/1934 |
| GB | 2 446 949 | 8/2008 |
| JP | 51160305 | 12/1976 |
| JP | 2002-37068 | 2/2002 |
| JP | 2002145062 | 5/2002 |
| JP | 2003276604 | 10/2003 |
| WO | WO 87/00566 | 1/1987 |
| WO | WO 02/25919 | 3/2002 |
| WO | WO 2003/064233 | 8/2003 |
| WO | WO 2003/095283 | 11/2003 |
| WO | WO 2006/015494 | 2/2006 |
| WO | WO 2008/096109 | 8/2008 |
| WO | WO 2010/033900 | 3/2010 |
| WO | WO 2010/033907 | 3/2010 |
| WO | WO 2010/138819 | 12/2010 |
| WO | WO 2014/029028 | 2/2014 |

OTHER PUBLICATIONS

L.B. Foster Rail Technologies, Inc., Examination Report from Australian Application No. 2009293041 dated Jun. 20, 2013.
L.B. Foster Rail Technologies, Inc., Canadian Notice of Allowance from Canadian Patent Application No. 2,737,370, dated Feb. 16, 2016, 1 page.
L.B. Foster Rail Technologies, Inc., Canadian Notice of Allowance from Canadian Patent Application No. 2,763,205, dated Nov. 2, 2015, 1 page.
L.B. Foster Rail Technologies, Inc., Canadian Notice of Allowance from Canadian Patent Application No. 2,869,485, dated Jan. 25, 2016, 1 page.
L.B. Foster Rail Technologies, Inc., Chinese Certificate of Patent from Chinese Patent Application No. 200980137073.2, dated Jan. 20, 2016, 3 pages.
L.B. Foster Rail Technologies, Inc., Chinese Certificate of Patent from Chinese Patent Application No. 20108031049.3, dated Jan. 13, 2016, 1 page.
L.B. Foster Rail Technologies, Inc., Chinese Decision on Rejection from Chinese Patent Application No. 201080031049.3, dated Jan. 13, 2015 (with English Translation).
L.B. Foster Rail Technologies, Inc., Chinese Office Action from Chinese Application No. 200980137073.2 dated Apr. 23, 2013 (English Translation).
Portec Rail Products, Inc., European Office Action from European Patent Application No. 09 815 329.9, dated Nov. 16, 2015, 4 pages.
L.B. Foster Rail Technologies, Inc., Chinese Notification of Grant of Patent Right for Invention from Chinese Patent Application No. 2010800310493, dated Oct. 10, 2015, 2 pages.
L.B. Foster Rail Technologies, Inc., United States Office Action from U.S. Appl. No. 14/075,829, dated Mar. 14, 2016, 29 pages.
L.B. Foster Rail Technologies, Inc., United States Restriction Requirement from U.S. Appl. No. 14/620,406, dated Oct. 23, 2015.
L.B. Foster Rail Technologies, Inc., United States Office Action from U.S. Appl. No. 14/620,406, dated Jan. 13, 2016.
Foster Rail Technologies, Inc., Notice of Allowance from Canadian Patent Application No. 2,622,561 dated Dec. 11, 2014, 1 page.
L.B. Foster Rail Technologies, Inc., Office Action from Canadian Patent Application No. 2,869,485 dated Jan. 7, 2015, 4 pages.
L.B. Foster Rail Technologies, Inc., Office Action from Chinese Patent Application No. 200980137073.2 dated Nov. 2, 2014, 10 pages.
L.B. Foster Rail Technologies, Inc., Office Action from Chinese Patent Application No. 200980137073.2 dated Jan. 29, 2015, 10 pages.
L.B. Foster Rail Technologies, Inc., International Preliminary Report on Patentability from International Patent Application No. PCT/CA2013/050654 dated Dec. 2, 2014, 8 pages.
L.B. Foster Rail Technologies, Inc., Office Action from U.S. Appl. No. 13/935,019 dated Oct. 30, 2014, 14 pages.
L.B. Foster Rail Technologies, Inc., Office Action from U.S. Appl. No. 13/593,189 dated Dec. 10, 2014, 13 pages.
Portec Rail Products, Inc., Final Office Action from U.S. Appl. No. 12/034,871 dated Apr. 4, 2013.
L.B. Foster Rail Technologies, Inc., Final Office Action from U.S. Appl. No. 13/063,553 dated Mar. 12, 2013.
Portec Rail Products, Inc., International Preliminary Report on Patentability from International Application No. PCT/US2009/057671 dated Mar. 22, 2011.
Portec Rail Products, Inc., International Search Report and Written Opinion from International Application No. PCT/US2009/057671 dated May 4, 2010.
Portec Rail Products, Inc., International Search Report and Written Opinion from International Application No. PCT/US2010/036582 dated Dec. 28, 2010.
L.B. Foster Rail Technologies, Inc., Non-Final Office Action from U.S. Appl. No. 13/063,553 dated Sep. 17, 2012.
L.B. Foster Rail Technologies, Inc., Office Action from Australian Patent Application No. 2010253819 dated Mar. 21, 2014.
L.B. Foster Rail Technologies, Inc., Office Action from Canadian Patent Application No. 2,622,561 dated Mar. 26, 2014.
L.B. Foster Rail Technologies, Inc., Office Action from Chinese Patent Application No. 200980137073.2 dated Dec. 20, 2013.
L.B. Foster Rail Technologies, Inc., Office Action from Chinese Patent Application No. 201080031049.3 dated Jul. 14, 2014. (English Translation).
L.B. Foster Rail Technologies, Inc., Office Action from Chinese Patent Application No. 201080031049.3 dated Dec. 2, 2013. (English Translation).
Portec Rail Products, Inc., Office Action from European Patent Application No. 09815329.9 dated Dec. 5, 2013.
L.B. Foster Rail Technologies, Inc., Final Office Action from U.S. Appl. No. 12/788,971 dated Mar. 14, 2013.
L.B. Foster Rail Technologies, Inc., Final Office Action from U.S. Appl. No. 13/935,019 dated Apr. 29, 2014.
L.B. Foster Rail Technologies, Inc., International Search Report and Written Opinion from International Application No. PCT/CA2013/050654 dated Oct. 18, 2013.
L.B. Foster Rail Technologies, Inc., Non-Final Office Action from U.S. Appl. No. 12/788,971 dated Jun. 19, 2014.
L.B. Foster Rail Technologies, Inc., Non-Final Office Action from U.S. Appl. No. 12/788,971 dated Nov. 27, 2012.
L.B. Foster Rail Technologies, Inc., Non-Final Office Action from U.S. Appl. No. 13/935,019 dated Nov. 14, 2013.
L.B. Foster Rail Technologies, Inc., Notice of Allowance from U.S. Appl. No. 13/063,553 dated Mar. 6, 2014.
L.B. Foster Rail Technologies, Inc., Restriction Requirement Office Action from U.S. Appl. No. 12/788,971 dated Oct. 12, 2012.
L.B. Foster Rail Technologies, Inc., Associate' s Translation of Chinese Office Action from Chinese Patent Application No. 200980137073.2 dated Jun. 5, 2014.
L.B. Foster Rail Technologies, Inc., Office Action from Canadian Patent Application No. 2,737,370, dated Sep. 1, 2015.
L.B. Foster Rail Technologies, Inc., Office Action from Canadian Patent Application No. 2,763,205, dated Jul. 23, 2015.
L.B. Foster Rail Technologies, Inc., Office Action from Canadian Patent Application No. 2,869,485, dated May 19, 2015.
L.B. Foster Rail Technologies, Inc., Office Action from Canadian Patent Application No. 2,869,485, dated Sep. 22, 2015.

(56) References Cited

OTHER PUBLICATIONS

L.B. Foster Rail Technologies, Inc., Restriction Requirement from U.S. Appl. No. 14/075,829, dated Sep. 29, 2015.
L.B. Foster Rail Technologies, Inc., Notice of Allowance from U.S. Appl. No. 13/593,189, dated Apr. 1, 2015.
L.B. Foster Rail Technologies, Inc., Office Action from Chinese Patent Application No. 200980137073.2, dated Jun. 1, 2015 (with Associate's Translation).
Portec Rail Products, Inc. Extended European Search Report for EP 10781279.4 dated Feb. 28, 2017, 6 pages.
L.B. Foster Rail Technologies, Inc., Office Action for U.S. Appl. No. 14/075,829 dated Mar. 14, 2016, 29 pages.
L.B. Foster Rail Technologies, Inc., Final Office Action for U.S. Appl. No. 14/075,829 dated Jul. 22, 2016, 19 pages.
L.B. Foster Rail Technologies, Inc., Office Action for U.S. Appl. No. 14/075,829 dated Nov. 4, 2016, 9 pages.
L.B. Foster Rail Technologies, Inc., Final Office Action for U.S. Appl. No. 14/075,829 dated Mar. 22, 2017, 9 pages.
L.B. Foster Rail Technologies, Inc., Notice of Allowance for CA 2,881,786, 1 page, dated Feb. 8, 2017.
European Patent Office Communication Under Rule 71(3) Intent to Grant dated Jun. 22, 2016 re EP 09815329.9, dated Jun. 22, 2016 pp. 1-7.
Notification of Transmittal of International Preliminary Report on Patentability issued in PCT/CA2013/050654, dated Dec. 2, 2014, pp. 1-8.
Notice of Allowance issued in U.S. Appl. No. 14/620,406, dated May 16, 2016, pp. 1-16.
Certificate of Grant for AU 2013305452, dated Sep. 22, 2016.

* cited by examiner 97
27
25
78
40
64
72
70
74
76
71
50
58
82
80
44
42
60
15
23
17
19
62
46
89
91
85
55
87

TOP OF RAIL FOAM BAR

CROSS REFERENCE TO RELATED APPLICATIONS

This application claims the benefit of U.S. Provisional Application No. 61/182,217, filed May 29, 2009, U.S. application Ser. No. 12/788,971, filed May 27, 2010, now issued U.S. Pat. No. 8,955,645, U.S. Continuation in Part application Ser. No. 14/075,829, filed Nov. 8, 2013, the entire contents of which are hereby incorporated by reference.

BACKGROUND OF THE INVENTION

Field of the Invention

The present invention relates to an apparatus for lubricating railroad rails or for applying friction modifiers to railroad rails.

Description of Related Art

In the operation of railroads, grease or friction modifier materials are applied onto railroad rails, such as to the top of rails or sides of the rails at curves, turnouts, switches, in some cases, the sections of the track immediately before a switch, and periodically spaced along the length of the track. Such lubricants and friction modifying materials, such as grease, can either reduce or increase the friction where necessary to improve train performance and reduce wear on both the rails and the train wheels. In the case of a friction modifying material that increases the friction between the train wheel and the rail, the practice has been to apply the friction modifier material to the top of the rail to contact the train wheels. Oftentimes, the friction modifying material does not reach the center of the rail or substantial amounts of friction modifying material are wasted by dripping or pouring to a position where the material is not needed.

SUMMARY OF THE INVENTION

In one embodiment, a rail applicator assembly includes a rail having a head portion, a base portion, and a web portion extending between the head portion and the base portion. The head portion defines an outer surface. The rail applicator assembly also includes an applicator for applying a friction modifying material to the outer surface of the rail. The applicator includes a foam body and an applicator support. The foam body is secured to the applicator support and defines a flow passageway that extends through the foam body for friction modifying material to flow through.

A top surface of the foam body may be inclined toward the head portion of the rail and the foam body may engage the head portion of the rail. The flow passageway may extend from a bottom surface to a top surface of the foam body with the top surface of the foam body defining an exit port of the flow passageway. The flow passageway may be angled towards a front surface of the foam body and the flow passageway may be wider at a top portion of the foam body than a lower portion of the foam body. The exit port of the flow passageway may be substantially slot-shaped. The flow passageway may also be substantially circular-shaped. The applicator support may include a generally C-shaped elongate body and may include a pair of extensions that extend from the generally C-shaped elongate body. A top surface of the foam body may include a rib generally extending in a longitudinal direction of the foam body. The rib may include at least one curved portion that extends towards the rail.

In a further embodiment, a rail applicator includes a foam body configured to apply friction modifying material to a surface of a rail. The foam body defines a flow passageway that extends through the foam body for friction modifying material to flow through. The applicator also includes an applicator support with the foam body being secured to the applicator support.

In another embodiment, a method of applying friction modifying material to a rail includes engaging a head portion of a rail with an applicator. The applicator includes a foam body and an applicator support. The foam body is secured to the applicator support and defines a flow passageway that extends through the foam body. The method also includes applying friction modifying material to the head portion of the rail by distributing the friction modifying material through the flow passageway and exiting the flow passageway via an exit port. The method may also include compressing the applicator such that the exit port is substantially closed prior to friction modifying material exiting through the exit port.

DESCRIPTION OF THE PREFERRED EMBODIMENTS

For purposes of the description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments. It is also to be understood that the specific devices illustrated in the accompanying drawing figures and described herein are simply exemplary and should not be considered as limiting.

Figure 1:
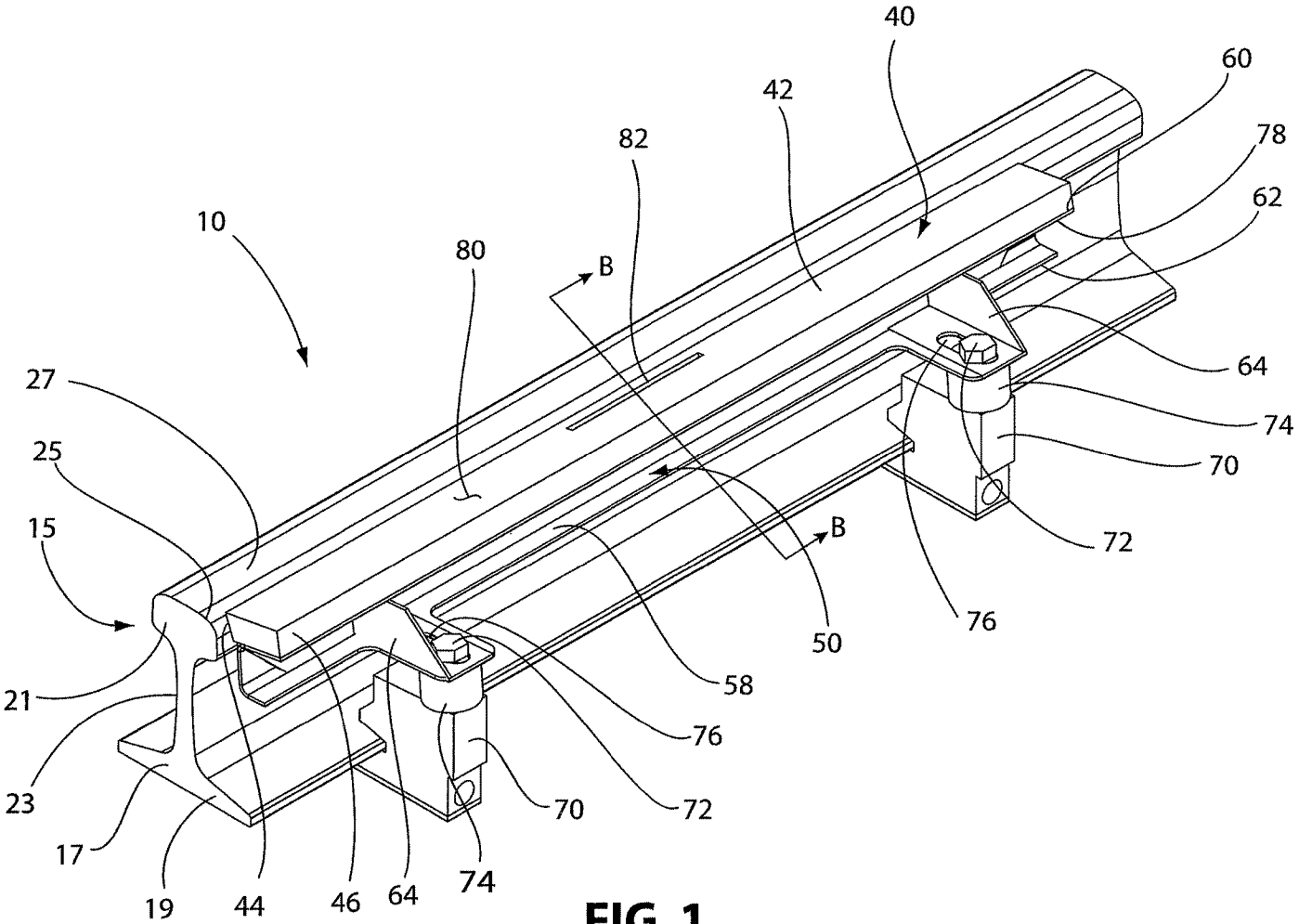
FIG. 1 is a perspective view of a rail applicator according to one embodiment of the present invention.
Figure 2:
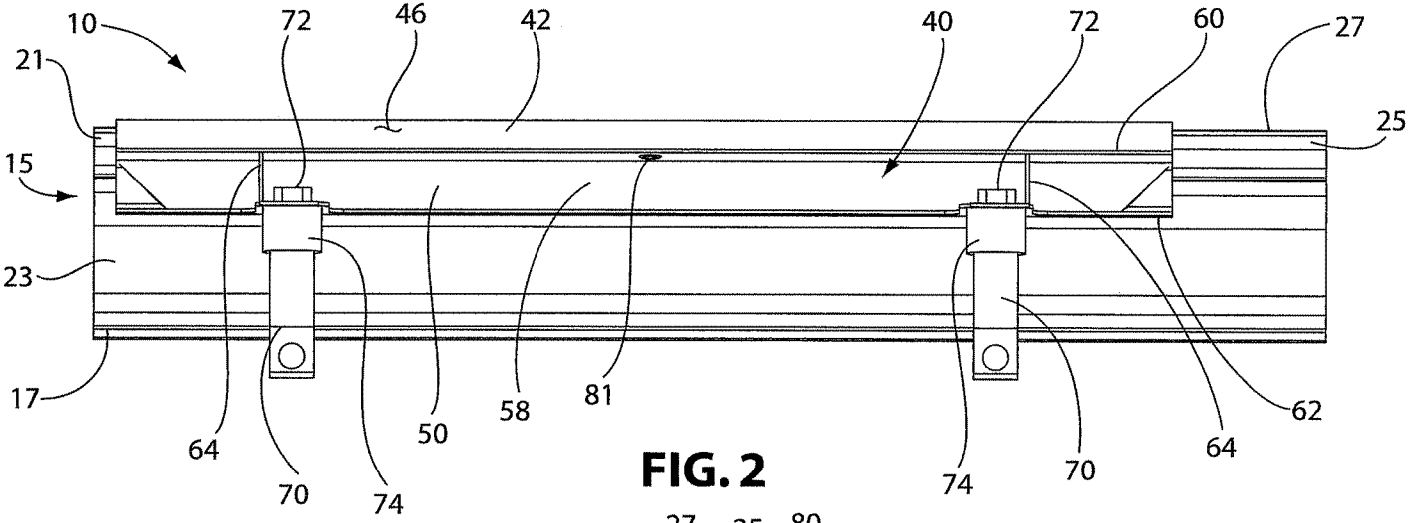
FIG. 2 is a rear view of the rail applicator shown in FIG. 1.
Figure 3:
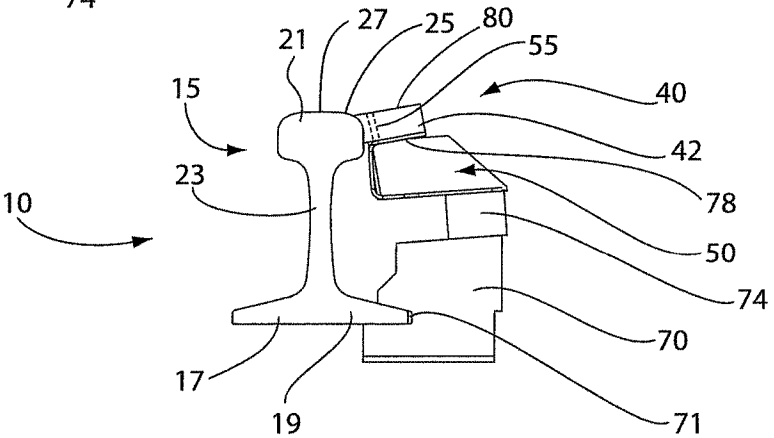
FIG. 3 is a side view of the rail applicator shown in FIG. 1.
Figure 4:
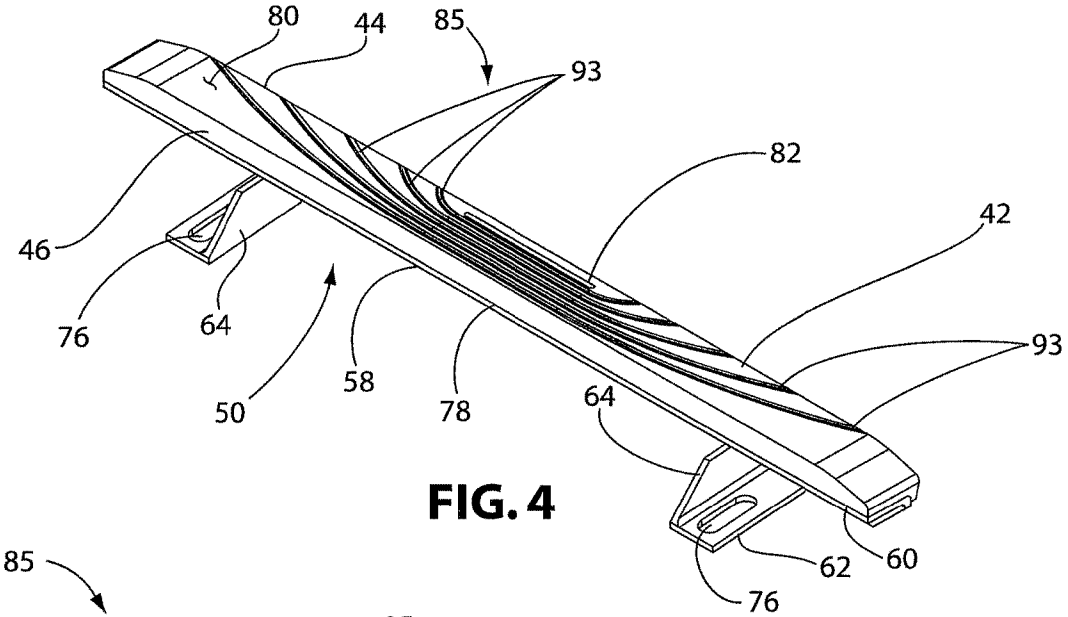
FIG. 4 is a perspective view of a rail applicator according to a further embodiment of the present invention.
Figure 5:
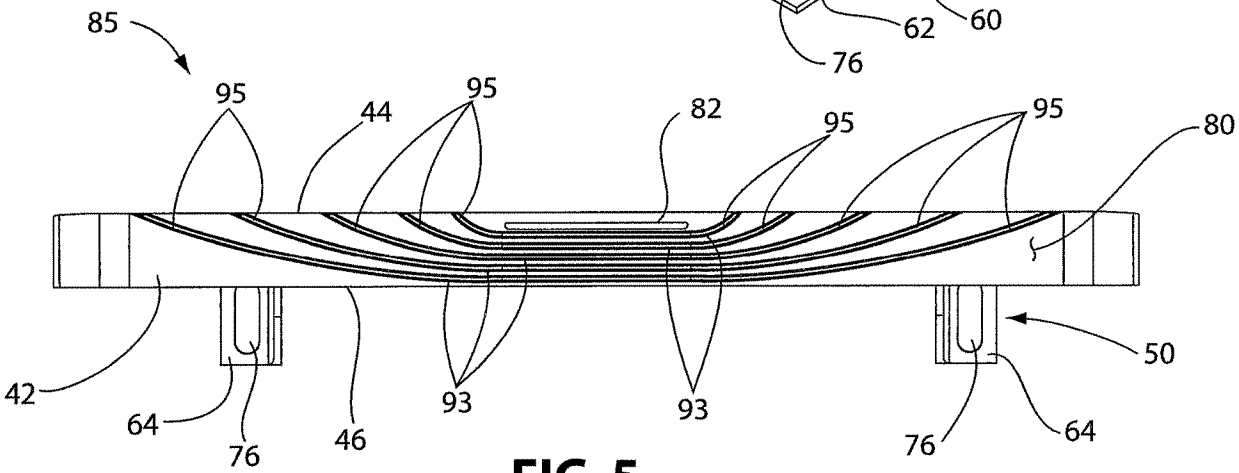
FIG. 5 is a top view of the rail applicator shown in FIG. 4.
Figure 6:
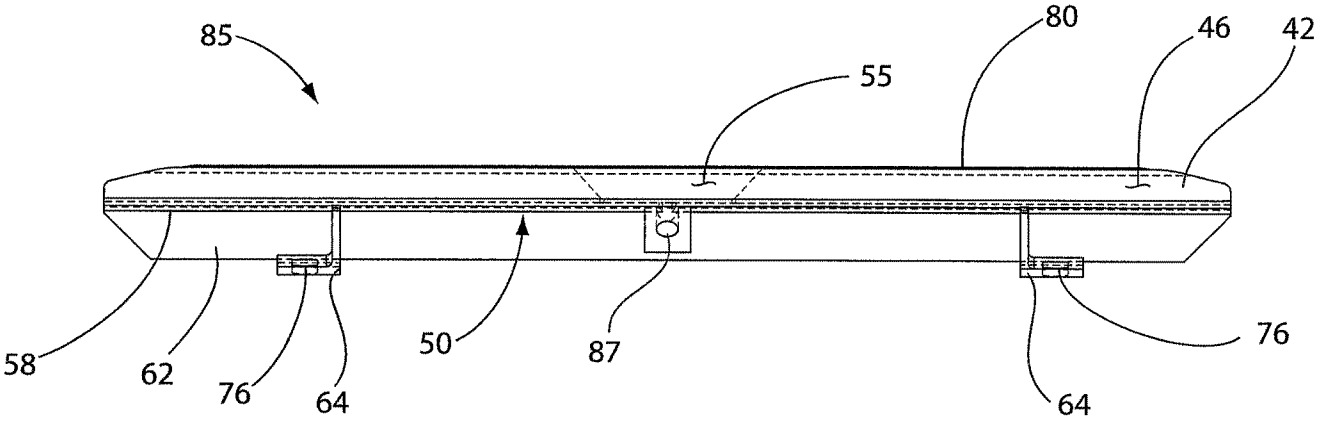
FIG. 6 is a rear view of the rail applicator shown in FIG. 4.
Figure 7:
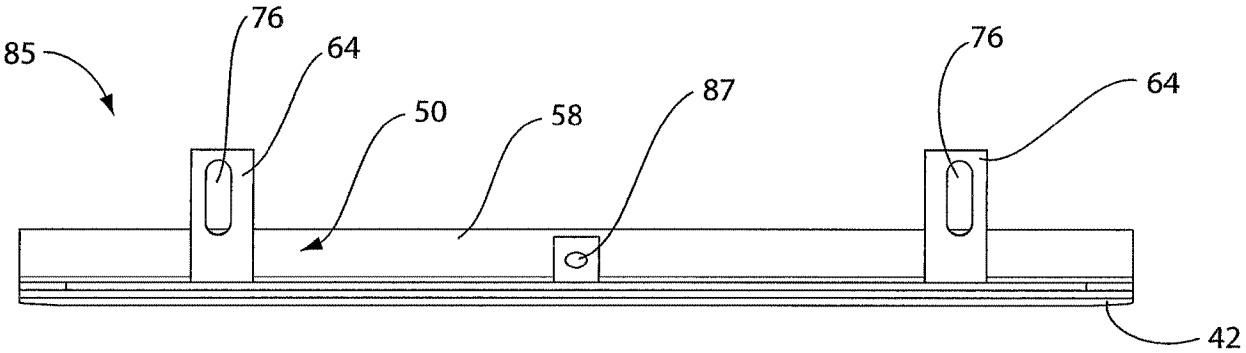
FIG. 7 is a bottom view of the rail applicator shown in FIG. 4.
Figure 8:
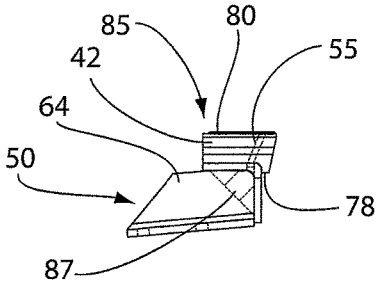
FIG. 8 is a side view of the rail applicator shown in FIG. 4.
Figure 10A:
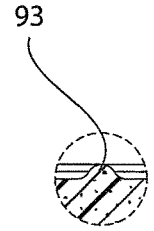
FIG. 10A is a detail view of the area shown in FIG. 10.
Figure 10:
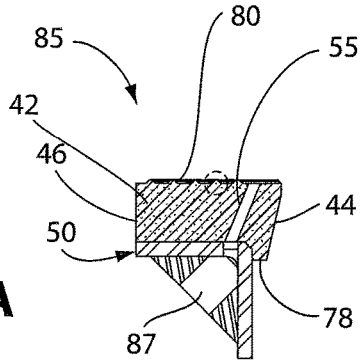
FIG. 10 is a cross-sectional view of the rail applicator shown in FIG. 4, taken along the line A-A of FIG. 9.
Figure 11:
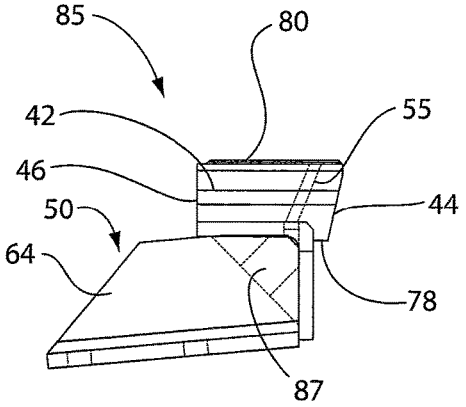
FIG. 11 is an enlarged side view of the rail applicator shown in FIG. 4.
Figure 9:
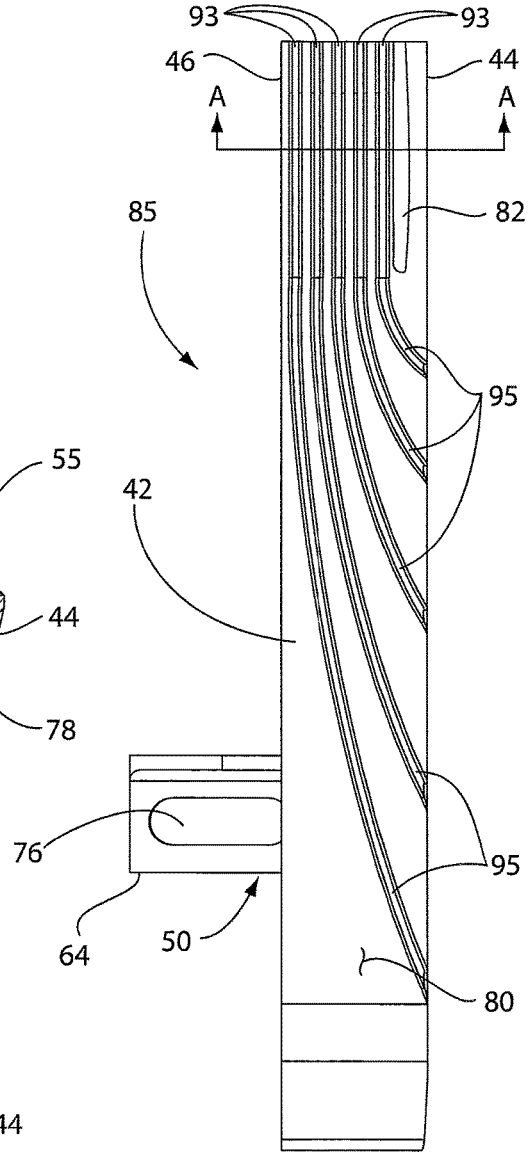
FIG. 9 is an enlarged partial top view of the rail applicator shown in FIG. 4.

Referring to FIGS. 1-3, one embodiment of a rail applicator assembly 10 is shown. The rail applicator assembly 10 includes a railroad rail 15 and an applicator 40 for applying a friction modifying material to the rail 15. The rail 15 includes a base portion 17 with flanges 19 extending therefrom and a head portion 21 having a web portion 23, which extends between the head portion 21 and the base portion 17. The head portion 21 of the rail 15 has an outer surface 25 defining a crown 27. The applicator 40 is configured to apply friction modifying material to the head portion 21 of the rail 15. The applicator 40 includes a polymeric or rubber foam body 42 having a front surface 44 and a rear surface 46 and an applicator support 50 for positioning and supporting the applicator 40 adjacent to the head portion 21. The foam body 42 is an elongate member generally having a rectangular shape, although other suitable shapes may be utilized for the foam body 42. The foam body 42 defines a flow passageway 55 that extends through the foam body 42 for the friction modifying material to flow through. The flow passageway 55 may be directly formed in the foam body 42. Alternatively, the flow passageway 55 may be defined by a separate insert (now shown) positioned within the foam body 42. The foam body 42 may be constructed of open-cell neoprene foam, although other suitable polymeric or rubber materials may be used, such as closed-cell foam or a combination of open-cell and closed-cell foam. Alternatively, a hollow rubber member having sufficient resiliency and flexibility may used instead of the foam body 42.

Referring again to FIGS. 1-3, the applicator support 50 includes a generally C-shaped elongate body 58 having an upper surface 60 and a lower surface 62. Further, a pair of extensions 64 extends from the elongate body 58 away from the rail 15. The foam body 42 is secured to the upper surface 60 of the applicator support 50. In particular, the foam body 42 may be directly formed on or bonded to the applicator support 50. The applicator 40 and applicator support 50 are mounted to the rail 15 through two mounting clamps 70. Each of the mounting clamps 70 have a recess 71 configured to receive the flange 19 of the rail 15. Each mounting clamp 70 also includes a bolt (not shown) having a J-shaped end configured to receive the flange 19 and a threaded end that passes through the mounting clamp 70. The mounting clamp 70 may be the same mounting clamp arrangement disclosed in U.S. Pat. No. 7,273,131, which is hereby incorporated herein by reference.

Referring to FIGS. 1 and 2, the extensions 64 of the applicator support 50 are secured to respective mounting clamps 70 via fasteners 72 with spacers 74 being provided between an upper surface of the mounting clamps 70 and the extensions 64. In particular, the fasteners 72, such as bolts, are inserted through respective openings 76 in the extensions 64 and are threadably secured to the mounting clamps 70 thereby securing the applicator support 50 to the mounting clamps 70. The openings 76 in the extensions 64 are generally slot-shaped to allow adjustment of the applicator 40 and support 50 relative to the rail 15, although other suitably shaped openings in each extension 64 may be utilized.

Referring again to FIGS. 1-3, the applicator 40 is arranged to provide friction modifying material adjacent the field surface or outside surface of the rail head 21 as opposed to the gauge surface or inside surface of the rail head 21. The applicator 40 is inclined downwardly toward the head portion 21 of the rail 15 to reduce the flow of friction modifying material in a direction opposite from the rail head 21. In particular, the front surface 44 of the foam body 42, which engages the head 21, has a lower position than the rear surface 46 of the foam body 42 relative to the rail head 21. Thus, the friction modifying material is provided through the flow passageway 55 of the foam body 42 and is maintained at a position adjacent to the outer surface 25 of the rail head 21 by the foam body 42. The foam body 42 deflects out of the way when contacted by a rail wheel and subsequently returns to its original position due to the resiliency and flexibility of the foam body 42.

Figures 12, 13:
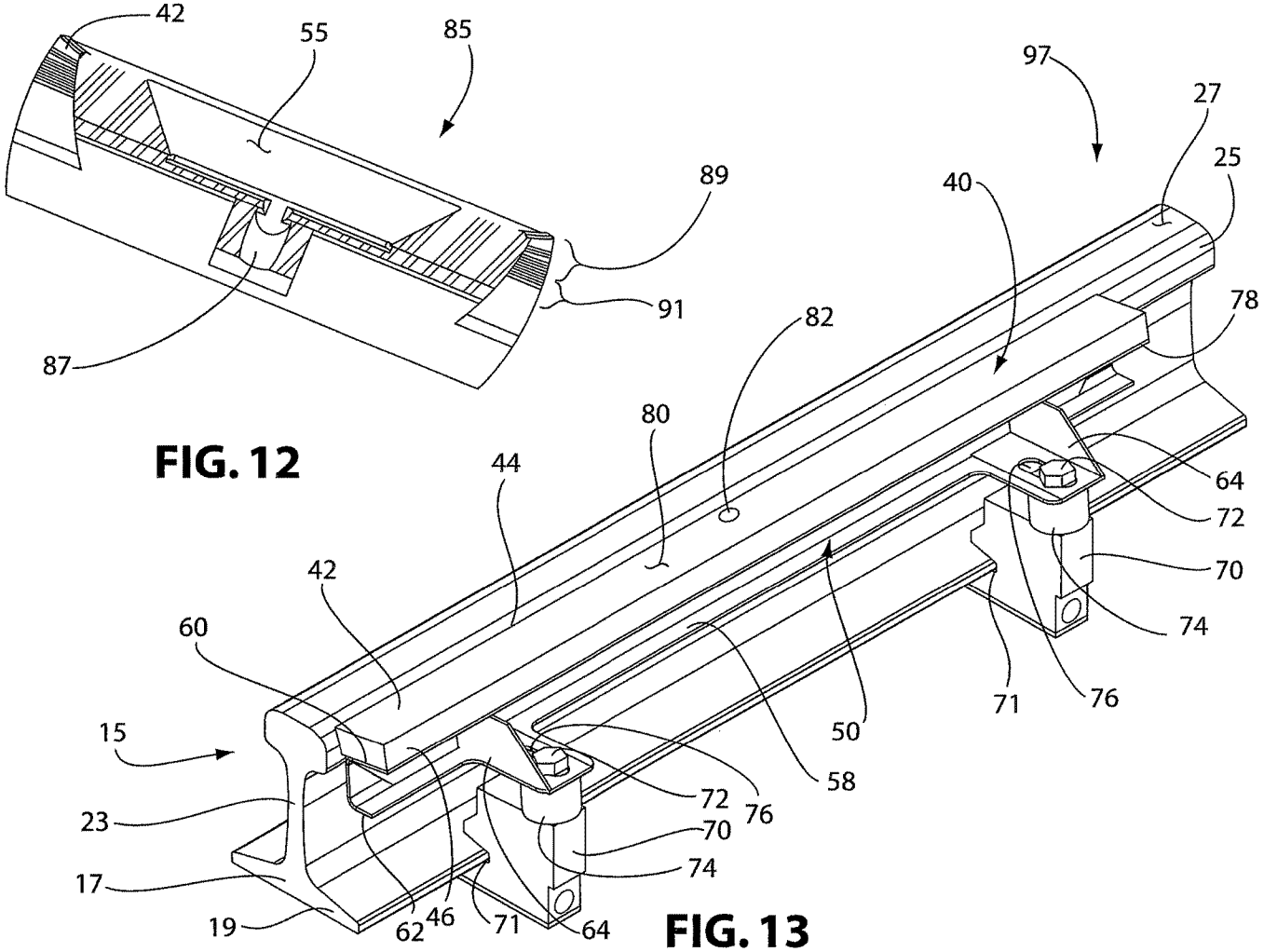
FIG. 12 is a partial sectional view of an intermediate portion of the rail applicator shown in FIG. 4.
FIG. 13 is a perspective view of a rail applicator according to another embodiment of the present invention.
Figure 14:
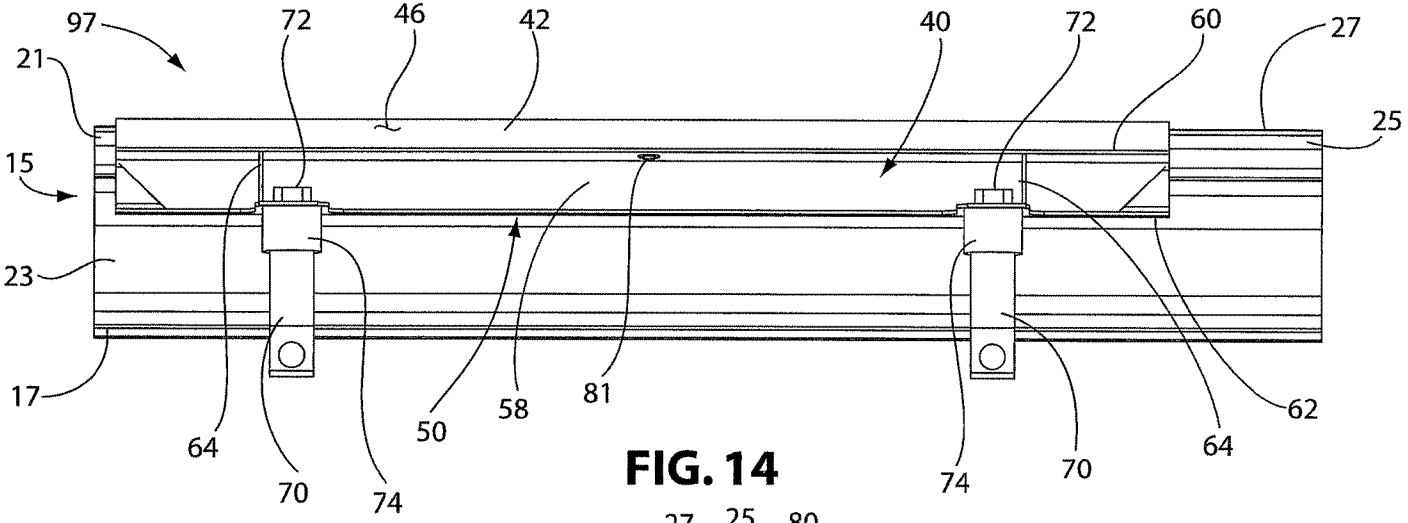
FIG. 14 is a rear view of the rail applicator shown in FIG. 13.
Figure 15:
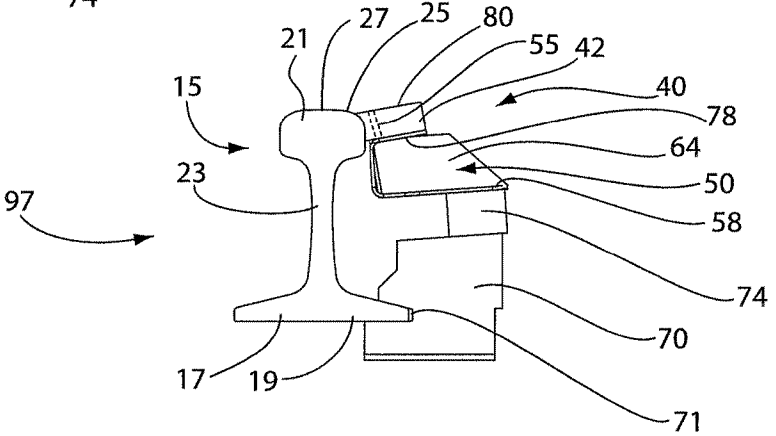
FIG. 15 is a side view of the rail applicator shown in FIG. 13.

As shown in FIGS. 1-3, the flow passageway 55 extends from a bottom surface 78 of the foam body 42 to a top surface 80 of the foam body 42. An inlet port 81 is defined by the applicator support 50 and the foam body 42. The inlet port 81 is in fluid communication with the flow passageway 55. The inlet port 81 is generally positioned at a central portion of the applicator support 50 and foam body 42, although other suitable positions for the inlet port 81 may be used. The top surface 80 of the foam body 42 defines an exit port 82 of the flow passageway 55. The exit port 82 of the flow passageway 55 is substantially slot-shaped, although other suitably shapes for the exit port 82 may be utilized. For instance, the exit port 82 may be a slit in the foam body 42 or may be substantially circular-shaped (as shown in FIGS. 13-15). When the foam body 42 is engaging the head portion 21 of the rail 15, the substantially slot-shaped exit port 82 closes at the top surface 80 of the foam body 42 due to the compression of the foam body 42 in the mounting position thereby allowing more free flow through the flow passageway 55 while sealing air from the exit port 82 at the top surface 80. The flow passageway 55 is also angled towards the front surface 44 of the foam body 42 as it extends from the bottom surface 78 to the top surface 80. The flow passageway 55, however, may extend in a direction that is perpendicular with the top surface 80 of the foam body 42 or any other suitable direction through the foam body 42. Although a single flow passageway 55 in the foam body 42 is disclosed, the applicator 40 may include a number of flow passageways 55.

Referring to FIGS. 4-12, a further embodiment of a rail applicator 85 is shown. The rail applicator is similar to the rail applicator 40 shown in FIGS. 1-3 and described above. The applicator 85 also includes a polymeric or rubber foam body 42 having a front surface 44 and a rear surface 46 and an applicator support 50 for positioning and supporting the applicator 85. As shown more clearly in FIGS. 10 and 11, the foam body 42 defines a flow passageway 55 that extends through the foam body 42 for the friction modifying material to flow through. The applicator support 50 includes an elongate body 58 having an upper surface 60 and a lower surface 62. A pair of extensions 64 extends from the elongate body 58.

Referring again to FIGS. 4-12, friction modifying material is provided to the flow passageway 55 via an inlet port 87 defined by the applicator support 50 and the foam body 42. The inlet port 87 is generally positioned at a central portion of the applicator support 50 and foam body 42, although other suitable positions for the inlet port 87 may be used. As shown more clearly in FIG. 10, the inlet port 87 is in fluid communication with the flow passageway 55. The friction modifying material may be supplied to the inlet port 87 via piping or tubing (not shown) that leads to a reservoir (not shown) containing the friction modifying material. A pump actuator (not shown) is secured to the rail and includes a pump that is in fluid communication with the reservoir.

As shown in FIG. 12, the flow passageway 55 is wider at a top portion 89 of the foam body 42 than a lower portion 91 of the foam body 42. In particular, the flow passageway 55 tapers outward as it extends from the bottom surface 78 to the top surface 80 of the foam body 42. The top surface 80 of the foam body 42 defines a plurality of ribs 93 generally extending in a longitudinal direction of the foam body 42. The ribs 93 extend outward from the top surface 80 of the foam body 42. Each of the ribs 93 include curved portions 95 at their ends that extend toward the front surface 44 of the foam body 42. The ribs 93 are configured to direct friction modifying material towards the front surface 44 of the foam body 42. Although a single flow passageway 55, inlet port 87, and exit port 82 are disclosed, the rail applicator 85 may include a number of flow passageways, inlet ports, and exit ports.

Referring to FIGS. 13-15, another embodiment of a rail applicator assembly 97 is shown. The rail applicator assembly 97 is similar to the rail applicator assembly 10 shown in FIGS. 1-3. Rather than providing a substantially slot-shaped exit port, however, the exit port 82 defined by the top surface 80 of the foam body 42 is substantially circular-shaped.

Figure 16A:
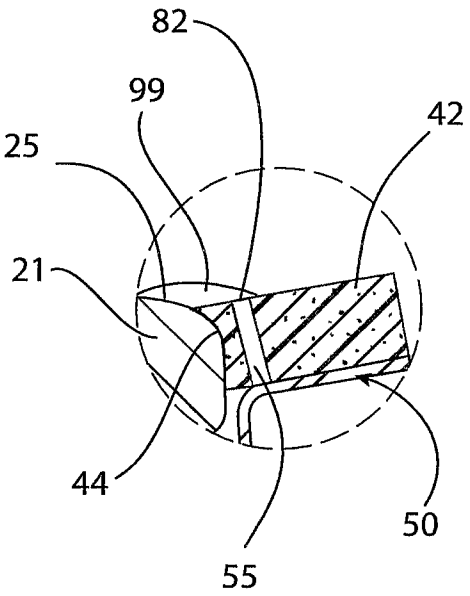
FIG. 16A is a detail view of the area shown in FIG. 16.
Figure 16:
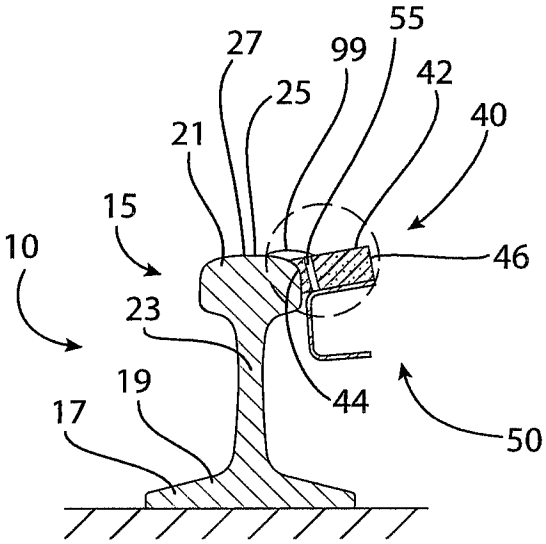
FIG. 16 is a cross-sectional view of the rail applicator shown in FIG. 1, taken along the line B-B of FIG. 1 and showing friction modifying material exiting the applicator.
Figure 17:
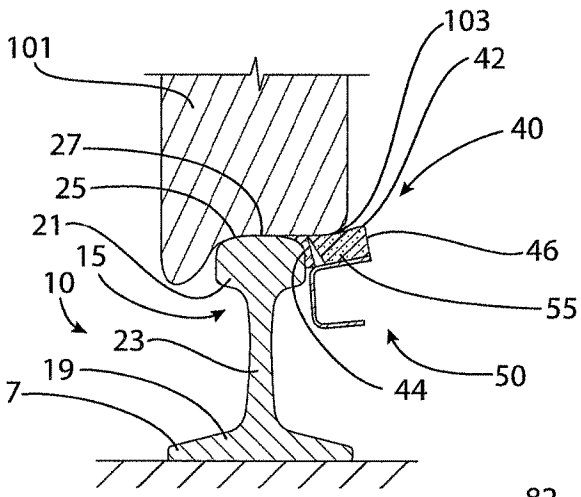
FIG. 17 is a cross-sectional view of the rail applicator shown in FIG. 1, taken along the line B-B of FIG. 1 and showing a rail wheel contacting the applicator.
Figure 18A:
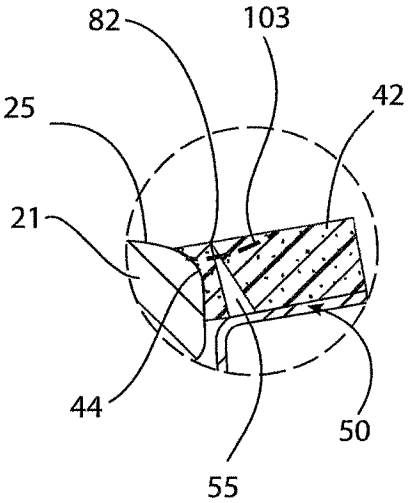
FIG. 18A is a detail view of the area shown in FIG. 18.
Figure 18:
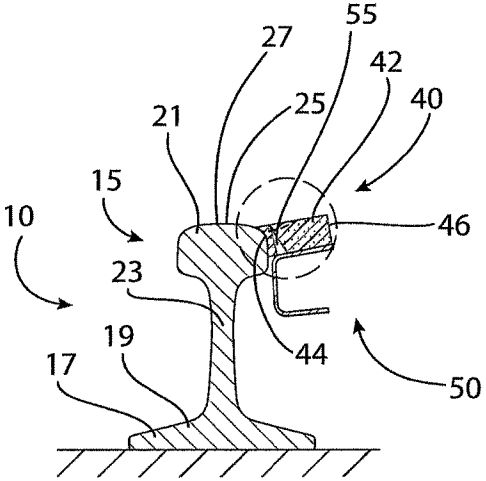
FIG. 18 is a cross-sectional view of the rail applicator shown in FIG. 1, taken along the line B-B shown in FIG. 1 and showing the applicator returning to form.

Referring to FIGS. 16-18A, the operation of the applicator 40 is disclosed. In particular, as shown in FIGS. 16 and 16A, the applicator 40 is positioned adjacent to the head portion 21 of the rail 15 in order to apply friction modifying material to the rail 15. The foam body 42 of the applicator 40 engages the head portion 21 of the rail, which compresses the foam body 42. Friction modifying material 99 is applied to the head portion 21 of the rail 15 by distributing the friction modifying material 99 through the flow passageway 55 and exiting the flow passageway 55 via the exit port 82. The foam body 42 contains the friction modifying material and directs the friction modifying material toward the crown 27 of the rail 15. As shown in FIG. 17, when rail wheel 101 passes the applicator 40, the wheel 101 engages and compresses the foam body 42 to define a depressed portion 103. The foam body 42 of the applicator 40 is configured to conform to the profile of the rail wheel 101 such that the applicator 40 accommodates new rail wheels or worn rail wheels having varying dimensions. As shown in FIGS. 18 and 18A, after the rail wheel 101 passes by the applicator 40, the depressed portion 103 of the foam body 42 caused by the passing wheel 101 expands and the foam body 42 returns to its original form. Further, as shown more clearly in FIGS. 16A and 18A, the foam body 42 of the applicator 40 is compressed against the rail 15 such that the exit port 82 is substantially closed when friction modifying material is not exiting through the exit port 82. This allows the exit port 82 to be closed when friction modifying material is not flowing through the flow passageway 55 (shown in FIG. 18A), but still allows free flow through the passageway 55 upon distribution of the friction modifying material (shown in FIG. 16A).

Figure 19:
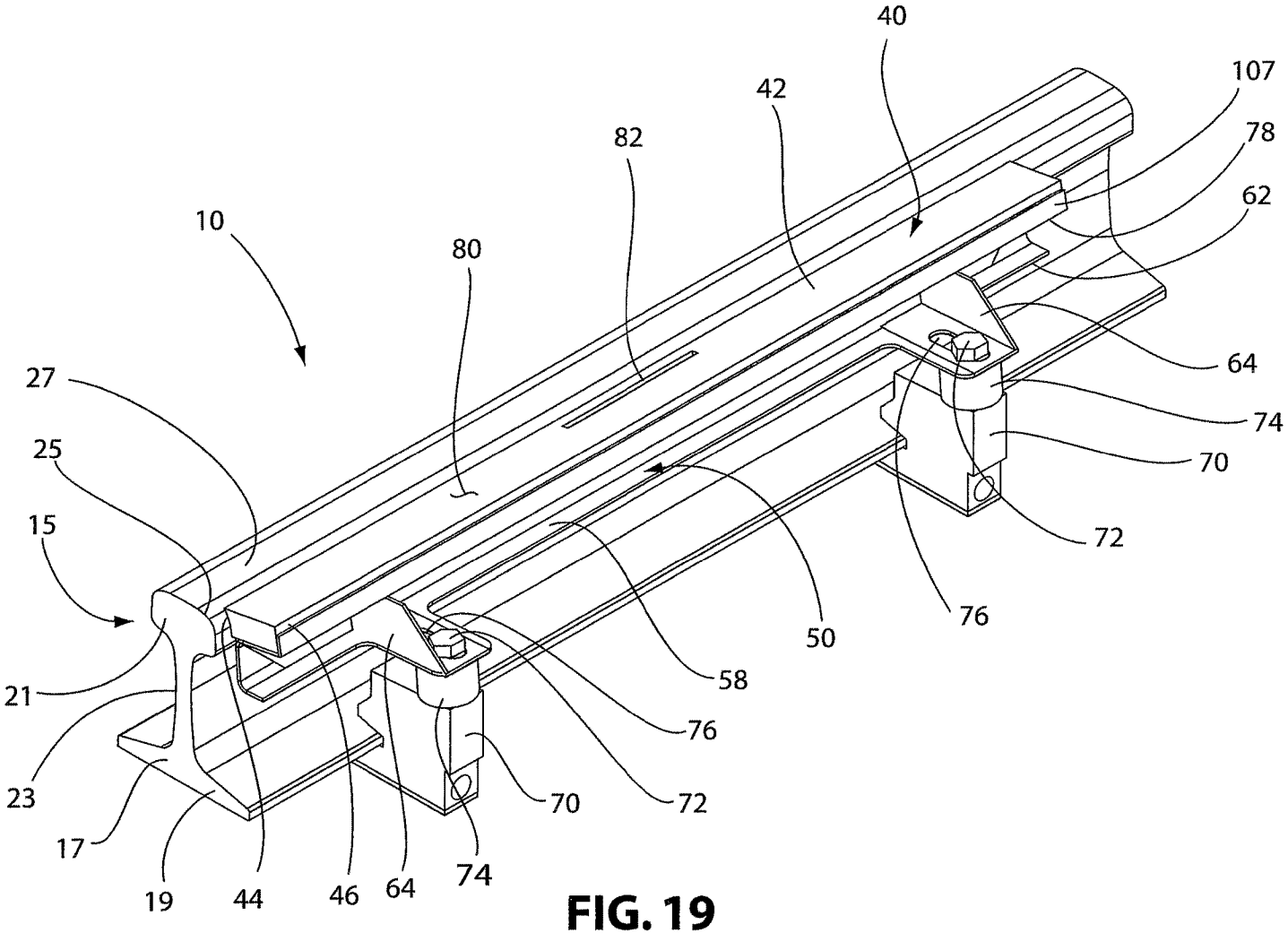
FIG. 19 is a perspective view of a rail applicator according to yet another embodiment of the present invention.
Figure 20:
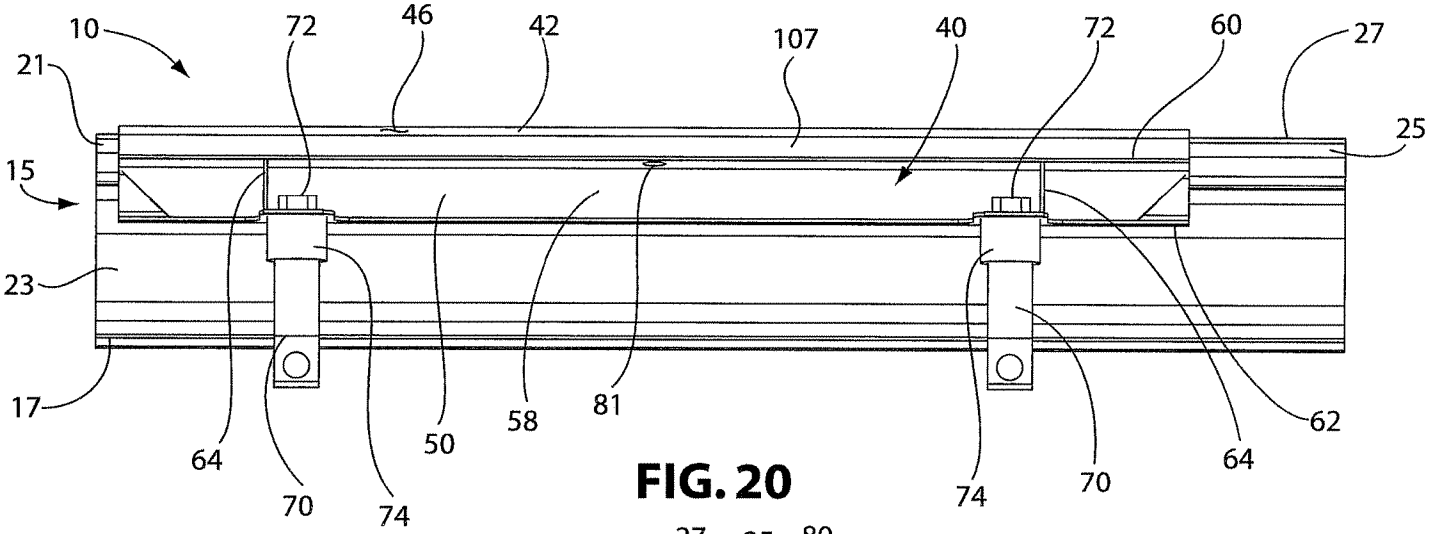
FIG. 20 is a rear view of the rail applicator shown in FIG. 19.
Figure 21:
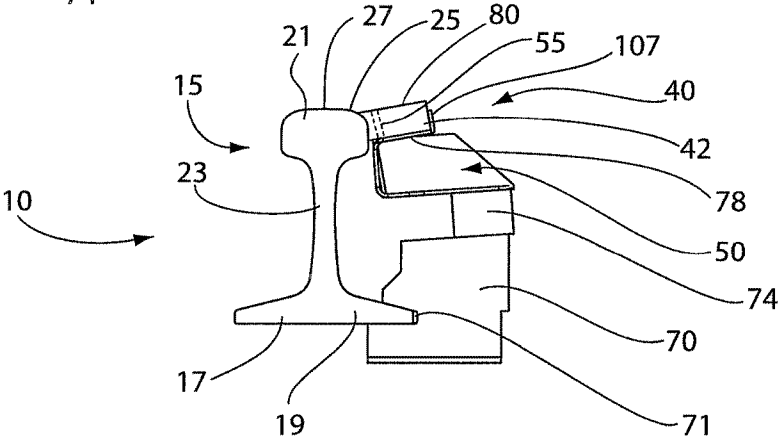
FIG. 21 is a side view of the rail applicator shown in FIG. 19.

Referring to FIGS. 19-21, yet another embodiment of a rail applicator assembly 105 is shown. The rail applicator assembly 105 is similar to the rail applicator assembly 10 shown in FIGS. 1-3. The applicator support 50 of the present embodiment, however, further includes an upward flange 107 extending from the upper surface of the elongate body 58. The upward flange 107 is positioned adjacent the rear surface 46 of the foam body 42 and is configured to provide support for the foam body 42 during compression by a passing rail wheel.

While several embodiments of a rail applicator were described in the foregoing detailed description, those skilled in the art may make modifications and alterations to these embodiments without departing from the scope and spirit of the invention. Accordingly, the foregoing description is intended to be illustrative rather than restrictive.

What is claimed is:

1. A rail applicator comprising:

an elongate resilient polymeric body configured to apply friction modifying material to a field surface of a head portion of a rail, the elongate resilient polymeric body comprising a flow passageway consisting of one conduit that extends through the elongate resilient polymeric body for the friction modifying material to flow through; and a rigid applicator support, wherein the elongate resilient polymeric body comprises a top surface and a bottom surface and wherein the bottom surface of the elongate resilient polymeric body is secured to a surface of the rigid applicator support, wherein the elongate resilient polymeric body is sufficiently resilient to compress when the top surface is contacted by a passing rail wheel and to subsequently return to its original position.

2. The rail applicator of claim 1, wherein the elongate resilient polymeric body comprises a length between the top surface and the bottom surface that is less than a length of a longitudinal axis of the top surface and wherein the rail applicator is configured such that the length of the top surface extends adjacent the head portion of the rail during use.

3. The rail applicator of claim 2, wherein the flow passageway is angled towards a front surface of the elongate resilient polymeric body.

4. The rail applicator of claim 1, wherein the elongate resilient polymeric body comprises an inlet port and an exit port and wherein the flow passageway is wider at the exit port than at the inlet port.

5. The rail applicator of claim 4, wherein the exit port of the flow passageway is substantially slot-shaped.

6. The rail applicator of claim 1, wherein the elongate resilient polymeric body comprises an inlet port and an exit port and wherein the flow passageway is the same width as the inlet port and the exit port, or narrower at the exit port than at the inlet port.

7. The rail applicator of claim 6, wherein the exit port of the flow passageway is substantially circular-shaped.

8. The rail applicator of claim 7, wherein the top surface of the elongate resilient polymeric body includes a rib generally extending along a longitudinal direction of the elongate resilient polymeric body.

9. The rail applicator of claim 8, wherein the rib includes at least one curved portion that extends towards a front end of the elongate resilient polymeric body.

10. The rail applicator of claim 1, wherein the elongate resilient polymeric body generally has a rectangular shape.

11. The rail applicator of claim 1, wherein the conduit extends between the top surface and the bottom surface.

12. The rail applicator of claim 1, wherein the applicator support is configured to couple to a mounting clamp comprising a recess configured to receive a flange portion of the rail.

13. The rail applicator of claim 1, wherein the elongate resilient polymeric body is a foam body.

14. The rail applicator of claim 1, wherein the applicator is configured such that the top surface of the elongate resilient polymeric body inclines downwardly toward the field surface during use.

15. The rail applicator of claim 1, wherein the elongate resilient polymeric body is a rubber body.

16. The rail applicator of claim 1, wherein a length of a longitudinal axis of the flow passageway is less than a length of a longitudinal axis of the elongate resilient polymeric body.

17. The rail applicator of claim 1, wherein the elongate resilient polymeric body is sufficiently resilient to deflect when contacted by a passing rail wheel and subsequently return to its original position.

18. The rail applicator of claim 1, wherein the surface of the rigid applicator support is planar.

19. The rail applicator of claim 1, wherein the applicator support comprises a generally C-shaped elongate body.

20. The rail applicator of claim 19, wherein the applicator support further comprises a pair of extensions extending from the generally C-shaped elongate body.

* * * * *